US005289152A

United States Patent [19]

Oguriyama et al.

[11] Patent Number: 5,289,152

[45] Date of Patent: Feb. 22, 1994

[54] PERMANENT MAGNET MAGNETIC CIRCUIT

[75] Inventors: Masami Oguriyama; Yoshio Ishigaki, both of Ichikawa; Haruo Okano, Tokyo; Isahiro Hasegawa, Zushi; Jun-ichi Arami, Hachioji; Hiromi Harada, Hiratsuka, all of Japan

[73] Assignees: TDK Corporation, Tokyo; Kabushiki Kaisha Toshiba, Kawasaki; Tokyo Electron Limited, Tokyo, all of Japan

[21] Appl. No.: 47,054

[22] Filed: Apr. 12, 1993

Related U.S. Application Data

[63] Continuation of Ser. No. 762,374, Sep. 19, 1991, abandoned.

[30] Foreign Application Priority Data

Sep. 19, 1990 [JP] Japan ..... 2-249040

[51] Int. Cl.[5] ..... H01F 7/02

[52] U.S. Cl. ..... 335/302

[58] Field of Search ..... 335/210-212, 335/296, 297, 302, 304, 306; 315/5.35; 250/396 ML; 310/90.5; 204/298.16-298.22

[56] References Cited

U.S. PATENT DOCUMENTS

| | | | |
|---|---|---|---|
| 2,925,517 | 2/1960 | Glass | 335/210 |
| 4,461,688 | 7/1984 | Morrison . | |
| 4,614,930 | 9/1986 | Hickey et al. | 335/302 |
| 4,672,346 | 6/1987 | Miyamoto | 335/296 |
| 4,810,986 | 3/1989 | Leupold | 335/304 |
| 4,842,707 | 7/1989 | Kinoshita | 204/298 |
| 4,964,968 | 10/1990 | Arita | 204/298.19 |

FOREIGN PATENT DOCUMENTS

| | | | |
|---|---|---|---|
| 969151 | 5/1958 | Fed. Rep. of Germany | 335/302 |
| 1287672 | 1/1969 | Fed. Rep. of Germany | 335/306 |
| 58-130277 | 8/1983 | Japan . | |
| 63-250458 | 10/1988 | Japan . | |
| 0163371 | 6/1990 | Japan | 204/298.19 |

*Primary Examiner*—Lincoln Donovan
*Assistant Examiner*—Raymond Barrera
*Attorney, Agent, or Firm*—Oblon, Spivak, McClelland, Maier & Neustadt

[57] ABSTRACT

A permanent magnet magnetic circuit is provided capable of producing a unidirectional magnetic field substantially free of unnecessary perpendicular magnetic field components. A pair of main magnetic poles of opposite polarities are situated at a pair of opposite edge surfaces of a permanent magnet block for producing lines of magnetic force. One major surface of the block between the edge surfaces is provided with a channel where a pair of auxiliary magnetic poles are situated at opposed inner surface portions of the channel for controlling a middle portion of the lines of magnetic force to be linear.

6 Claims, 9 Drawing Sheets

PERMANENT MAGNET MAGNETIC CIRCUIT

This application is a continuation of application Ser. No. 07/762,374, filed on Sep. 19, 1991, now abandoned.

This invention relates to a permanent magnet magnetic circuit. Such permanent magnet magnetic circuits are used in semiconductor manufacturing apparatus and similar apparatus requiring a unidirectional magnetic field having linear lines of magnetic force in a desired region and are especially useful when restrictions are imposed on their attachment or arrangement.

BACKGROUND OF THE INVENTION

Referring to FIG. 11, there is illustrated a first example of prior art permanent magnet magnetic circuits. The circuit includes a U-shaped yoke 2 having opposed legs. A pair of permanent magnets 1A and 1B are attached to the inside surfaces of the yoke legs such that the N pole of one magnet 1A is opposed to the S pole of the other magnet 1B. This arrangement creates a unidirectional magnetic field containing the least number of unnecessary perpendicular magnetic field components.

In the first prior art circuit of FIG. 11, however, a region E1 where the unidirectional magnetic field is produced is surrounded at three sides by the magnetic circuit. This magnetic circuit is not useful where restrictions are imposed on its attachment or location. For example, this first prior art circuit cannot be applied under the requirement that the magnetic circuit should not protrude beyond the lower boundary line F1 of the unidirectional magnetic field generating region E1. Such restrictions arise, for example, when it is desired for a magnetic circuit located outside a vacuum vessel to provide a region E1 of unidirectional magnetic field within the vacuum container interior.

FIGS. 12 and 13 show a second example of the prior art, illustrating a most fundamental magnetic circuit. A plate-shaped permanent magnet 5 has N and S poles disposed at opposite edges. A region E2 of approximate unidirectional magnetic field is available above (or below) one major surface of the plate shaped permanent magnet 5 as seen from FIG. 13. The magnetic circuit can be located only below (or above) the boundary line F2 of the approximate unidirectional magnetic field region E2.

FIG. 14 shows the distribution of lines of magnetic force generated in the second prior art circuit of FIGS. 12 and 13. In this example, the plate shaped permanent magnet 5 is a ferrite permanent magnet having a lateral dimension Lx of 250 nm, a transverse dimension Ly of 300 mm and a thickness Lz of 24 mm.

Assume that X is a horizontal distance from the center of the plate-shaped permanent magnet 5 and the vertical distance H from the major surface of the plate-shaped permanent magnet 5 is fixed to 40 mm. In FIG. 6, broken line curves show horizontal and vertical (or perpendicular) components Bx and Bz of the magnetic flux density as a function of distance X in the range of from 0 to $W/2=80$ mm. It is understood from the broken line curves in FIG. 6 and FIG. 14 that the second prior art circuit of FIGS. 12 and 13 produces a magnetic field which is far from an ideal unidirectional magnetic field free of perpendicular components since the unnecessary vertical component Bz drastically increases with the increasing distance X from the center of the plate-shaped permanent magnet 5.

SUMMARY OF THE INVENTION

Therefore, an object of the present invention is to provide a permanent magnet magnetic circuit capable of producing a unidirectional magnetic field free of perpendicular components and of a simple structure which does not surround the unidirectional magnetic field producing region.

In a first form of the present invention, the permanent magnet magnetic circuit includes a magnet block having a pair of opposite edge surfaces and a pair of major surfaces between the opposite edge surfaces. A pair of main magnetic poles of opposite polarities are situated at the opposite edge surfaces. A channel is defined in one major surface. A pair of auxiliary magnetic poles are situated at a pair of opposed inner surface portions of the channel disposed inside the main magnetic poles. Each auxiliary magnetic pole has opposite polarity to that of the corresponding main magnetic pole. The channel may be recessed stepwise or continuously to define the opposed inner surface portions.

In a second form of the invention, the permanent magnet magnetic circuit includes a magnet block having a pair of opposite edge surfaces, with a magnetic pole of one polarity at one edge surface and a magnetic pole of opposite polarity at the other edge surface for creating a magnetic field having lines of magnetic force extending from the one edge surface to the other edge surface. Compensating magnetic poles are situated between the edge surfaces for controlling the vectorial direction of the magnetic field.

In a third form of the invention, the permanent magnet magnetic circuit includes a magnet block having a pair of opposite edge surfaces. Main magnetic means is provided for creating a loop pattern of lines of magnetic force extending from the one edge surface to the other edge surface. Compensating magnetic means is provided for controlling a middle portion of the lines of magnetic force to be linear. Preferably, the main magnetic means is comprised of a magnetic pole of one polarity at one edge surface and a magnetic pole of opposite polarity at the other edge surface, and the compensating magnetic means is comprised of auxiliary magnetic poles.

In the permanent magnet magnetic circuit of the present invention, a vertical component contained in the magnetic field produced between the main magnetic poles (a magnetic field component perpendicular to the desired unidirectional magnetic field component) can be offset by a vertical component of opposite orientation contained in the magnetic field produced between the main and auxiliary (or compensating) magnetic poles. There can be formed a unidirectional magnetic field free of unnecessary vertical component over a wide area. The unidirectional magnetic field region is spaced from the magnet block so that the magnetic circuit does not surround the unidirectional magnetic field region. The circuit is thus best suited as the unidirectional magnetic field producing means associated with semiconductor manufacturing apparatus.

DESCRIPTION OF THE PREFERRED EMBODIMENTS

Figure 1:
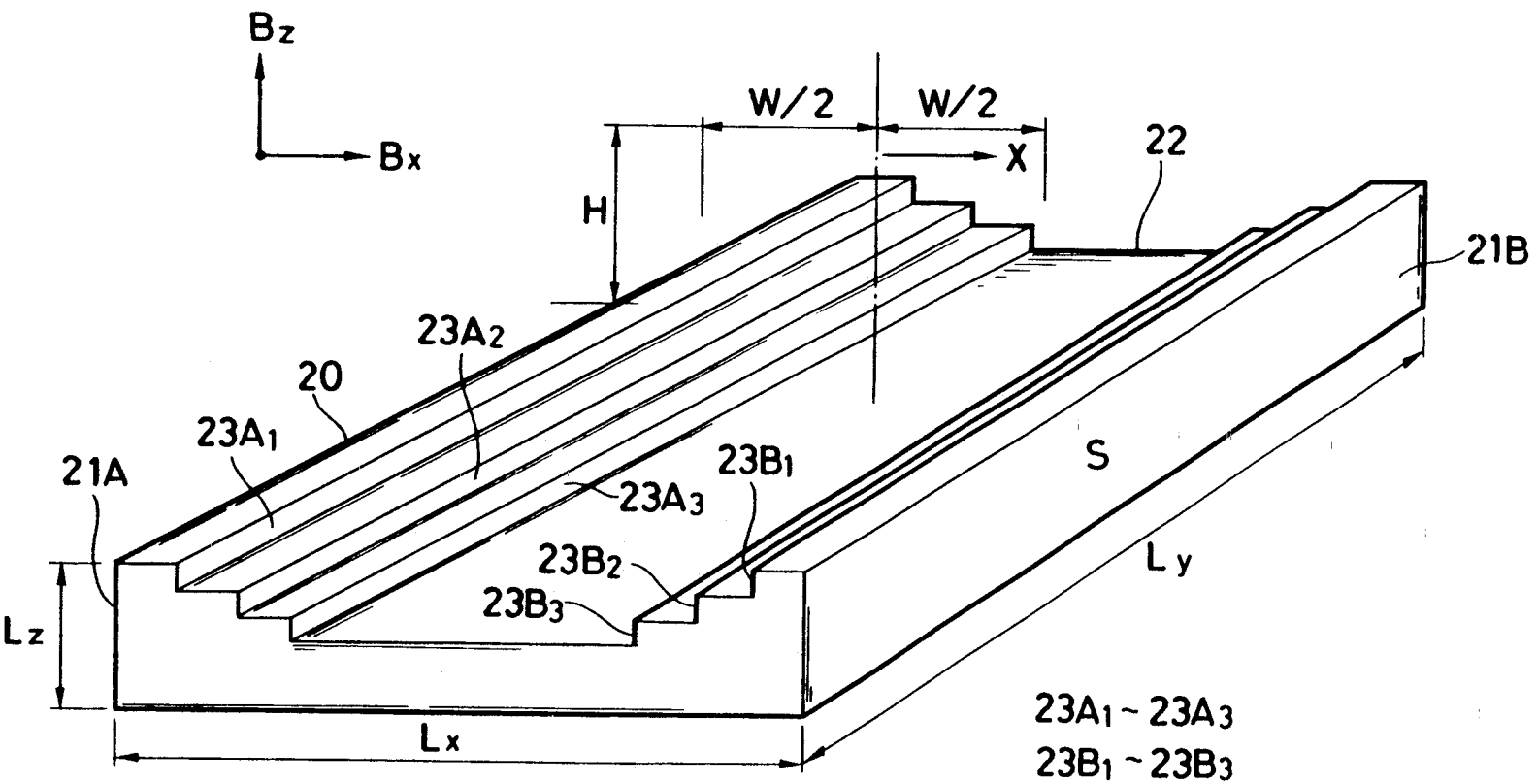
FIGS. 1 and 2 are perspective and front elevational views of a permanent magnet magnetic circuit according to a first embodiment of the present invention, respectively.
Figure 2:
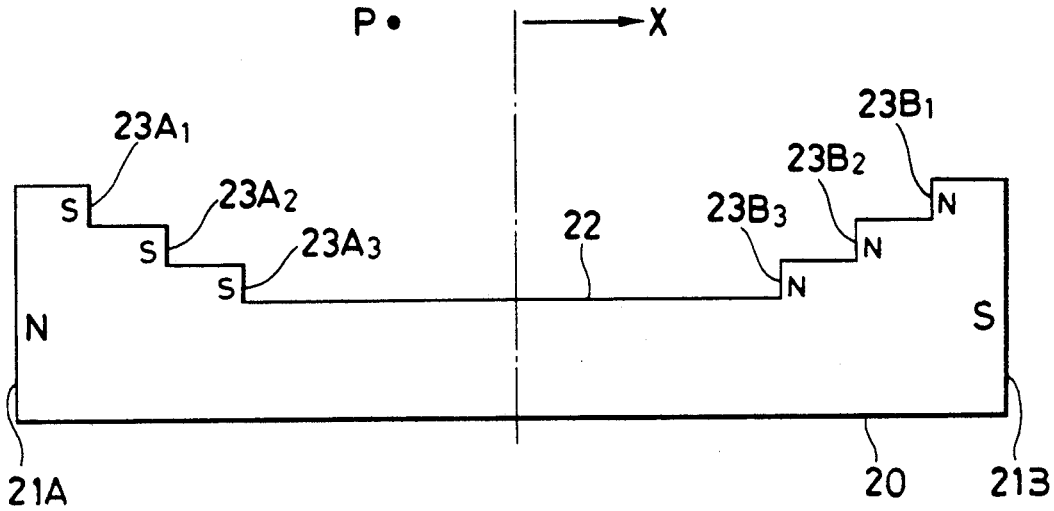

Referring to FIGS. 1 and 2, there is illustrated a permanent magnet magnetic circuit according to a first embodiment of the present invention. The circuit includes a rectangular magnet block 20 of a suitable permanent magnet material such as ferrite or rare earth permanent magnet. The block 20 has a pair of first and second opposite edge or outer surfaces and a pair of major surfaces joining the first and second opposite edge surfaces and extending substantially perpendicular to the edge surfaces. Main magnetic poles 21A and 21B are formed in the first and second opposite edge surfaces by magnetization. In the illustrated embodiment, the main magnetic poles 21A and 21B are N and S poles, respectively. A channel 22 is defined in one (upper in the illustrated embodiment) major surface. The channel 22 illustrated herein is a transverse trough extending throughout the block 20 in a transverse direction and recessed stepwise at the right and left sides in a symmetrical manner as viewed in the front elevation of FIG. 2. A flat bottom is connected to the stepwise side walls. The channel includes at least one pair, three pairs in the illustrated embodiment, of steps defining opposed inner surface portions disposed inward of the opposite edge surfaces (21A, 21B). Auxiliary magnetic poles in the form of compensating magnetic poles $23A_1$, $23A_2$ and $23A_3$ are formed by magnetization in the inner surface portions on the left side disposed inward of the main magnetic pole 21A. Similarly, auxiliary magnetic poles in the form of compensating magnetic poles $23B_1$, $23B_2$ and $23B_3$ are formed by magnetization in the inner surface portions on the right side disposed inward of the main magnetic pole 21B. The auxiliary magnetic poles have opposite polarity to that of the main magnetic poles. The compensating magnetic poles $23A_1$, $23A_2$ and $23A_3$ are S poles and the compensating magnetic poles $23B_1$, $23B_2$ and $23B_3$ are N poles.

If the magnet block 20 is of uniform material, the main and auxiliary magnetic poles 21 and 23 have equal surface magnetic flux density, but the main magnetic poles have a substantially larger total quantity of magnetic flux. The compensating magnetic poles 23 function to compensate for magnetic force for tailoring the lines of magnetic force produced by the main magnetic poles 21 to be linear.

Figure 3:
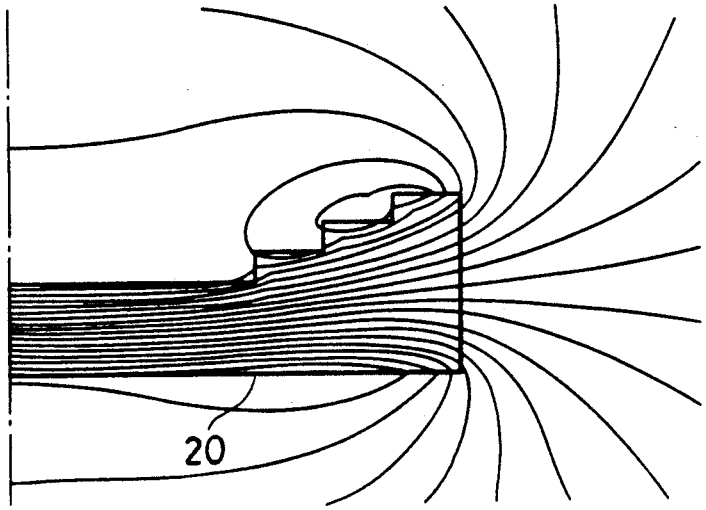
FIG. 3 illustrates the distribution of lines of magnetic force near the right edge of the magnet block in FIG. 2.
Figure 4:
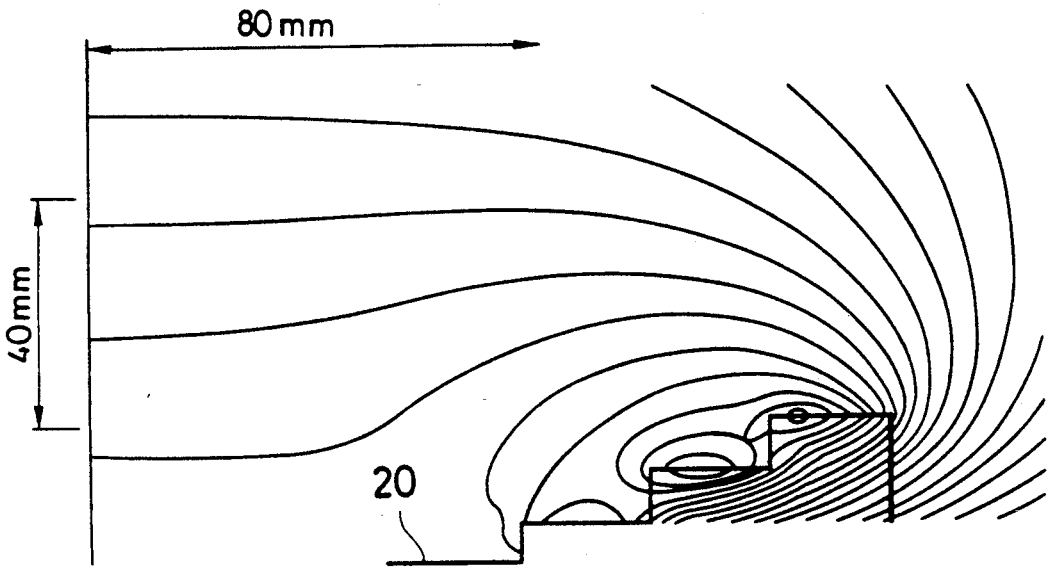
FIG. 4 is an enlarged view of a portion of FIG. 3.

FIG. 3 shows the distribution of lines of magnetic force generated in the magnetic circuit embodiment of FIGS. 1 and 2. FIG. 4 is an enlarged view of a portion of FIG. 3. In this embodiment, the magnet block 20 is a ferrite permanent magnet having a lateral dimension Lx of 250 mm, a transverse dimension Ly of 300 mm and a thickness Lz of 60 mm and the channel 22 defined therein includes three pairs of opposed steps each having a lateral width of 20 mm and a height of 10 mm.

Figure 6:
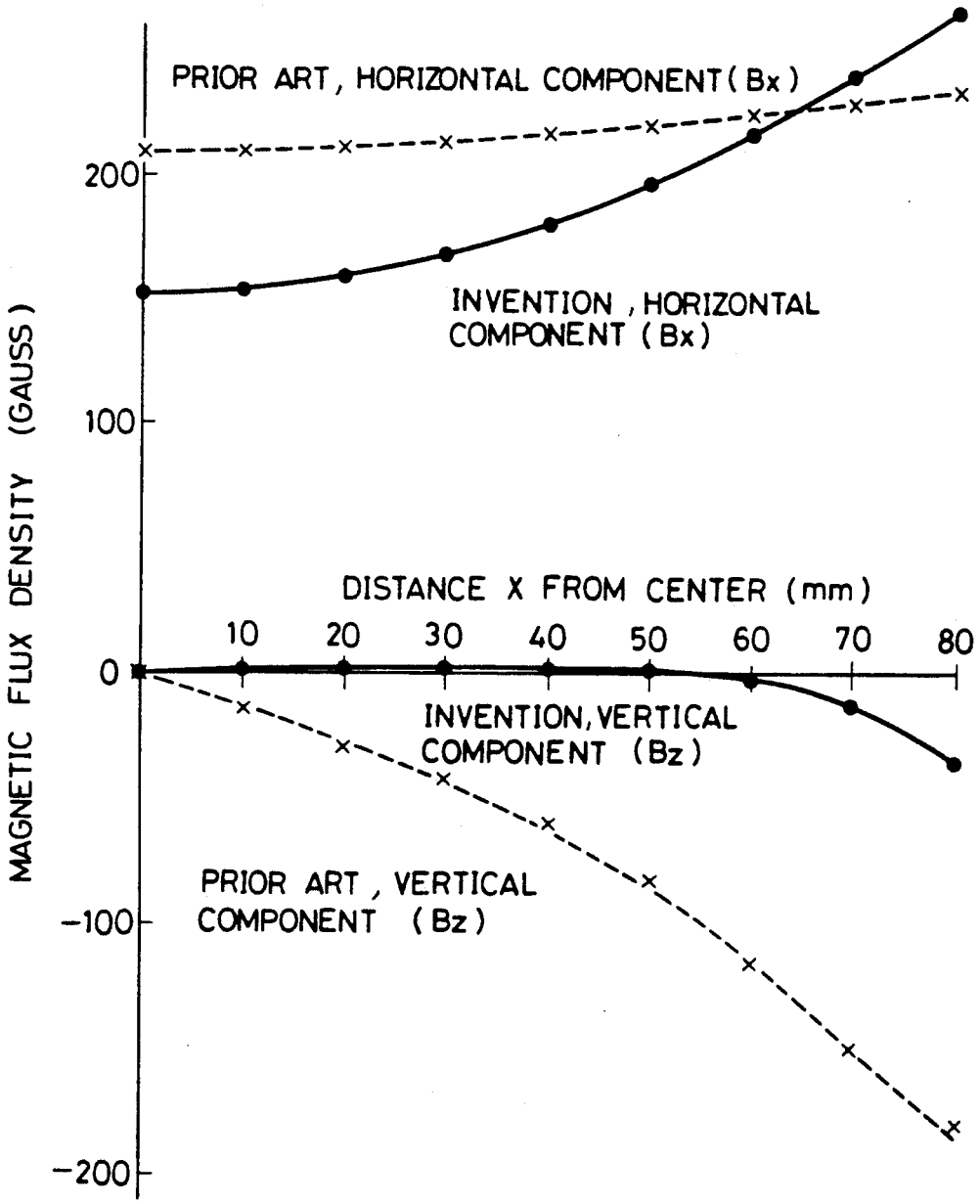
FIG. 6 is a diagram showing the magnetic flux density in horizontal and vertical directions relative to the distance from the magnet block center in the first embodiment of the present invention and the second example of the prior art.

Assume that X is a horizontal distance from the center (depicted by a phantom line) of the magnet block 20 and the vertical distance H from the upper major surface of the magnet block 20 is fixed to 40 mm. In FIG. 6, solid line curves show horizontal and vertical (or perpendicular) components Bx and Bz of the magnetic flux density as a function of distance X in the range of from 0 to $W/2=80$ mm.

Figure 5:
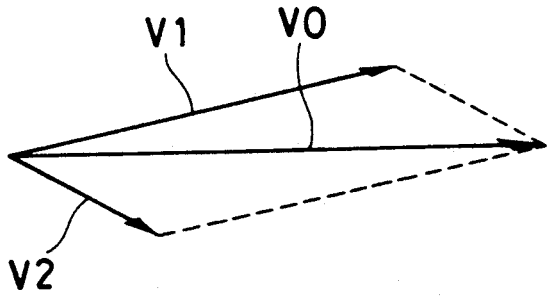
FIG. 5 illustrates a vector of the magnetic field between main magnetic poles, a vector of the magnetic field between a main magnetic pole and a compensating magnetic pole, and a resultant vector in the first embodiment.

It is understood from FIGS. 3 and 4 and the solid line curves in FIG. 6 that the first embodiment of FIGS. 1 and 2 produces a magnetic field whose unnecessary vertical component Bz is substantially equal to zero over a substantial portion of the X range. The reason is given below. As shown in FIG. 5 taken together with FIG. 2, at a point P in the region where a unidirectional magnetic field is to be produced, the magnetic field has a vector V1 directing from the main N pole toward the main S pole and a vector V2 extending between each main magnetic pole (N or S pole) and each compensating magnetic pole (S or N pole). The magnetic poles are arranged such that the resultant magnetic field vector V0 may become substantially horizontal.

Consequently, the first embodiment of FIGS. 1 and 2 produces a nearly ideal unidirectional magnetic field substantially free of unnecessary perpendicular components over a wide range. The magnetic circuit may be located on one side of the unidirectional magnetic field region because the magnetic circuit does not enclose the unidirectional magnetic field.

Figure 7:
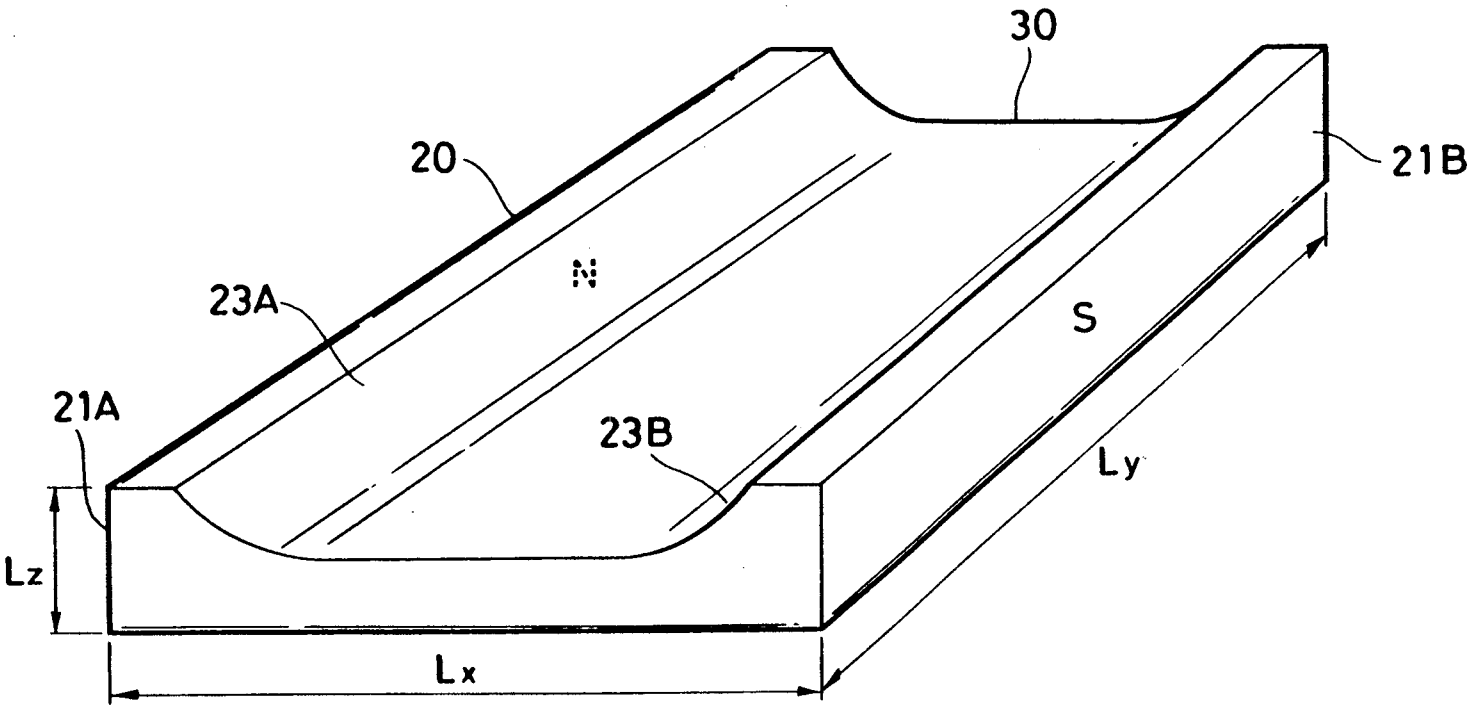
FIGS. 7 and 8 are perspective and front elevational views of a permanent magnet magnetic circuit according to a second embodiment of the present invention, respectively.
Figure 8:
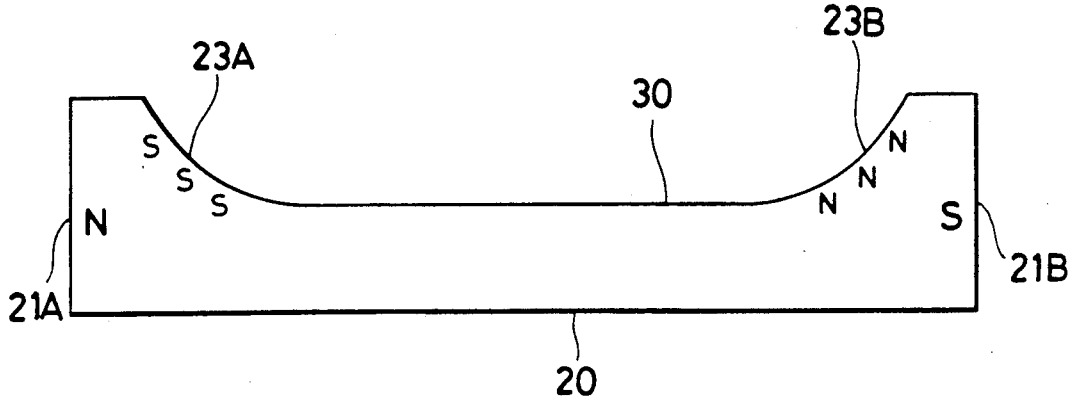

FIGS. 7 and 8 show a second embodiment of the present invention. This embodiment is similar to the first embodiment except for the channel geometry. Instead of the stepwise side wall channel, the magnet block 20 includes a continuously or smoothly recessed channel 30 in one major surface between the opposite edge surfaces. The continuous channel used herein means that the opposed inner side walls are curvilinear or rectilinear slant walls joining to a flat bottom. The inner side walls are symmetrical as viewed in the elevation of FIG. 8. Compensating magnetic poles 23A and 23B are formed by magnetization in the opposed inner side walls disposed inward of the main magnetic poles 21A and 21B, respectively. In the illustrated embodiment, the main magnetic poles 21A and 21B are N and S, and the compensating magnetic poles 23A and 23B are S and N, respectively.

In this embodiment, the magnet block 20 is a ferrite permanent magnet having a lateral dimension Lx of 250 mm, a transverse dimension Ly of 300 mm and a thickness Lz of 60 mm and the channel 30 defined therein includes a flat bottom having a lateral dimension of 130 mm and a thickness of 30 mm.

Also in the second embodiment of FIGS. 7 and 8, the magnetic poles are arranged such that the resultant magnetic field vector V0 between a vector V1 directing from the main N pole toward the main S pole and a vector V2 directing from each main magnetic pole (N or S pole) toward each compensating magnetic pole (S or N pole) in the region where a unidirectional magnetic field is to be produced as shown in FIG. 5 becomes substantially horizontal.

Figure 9:
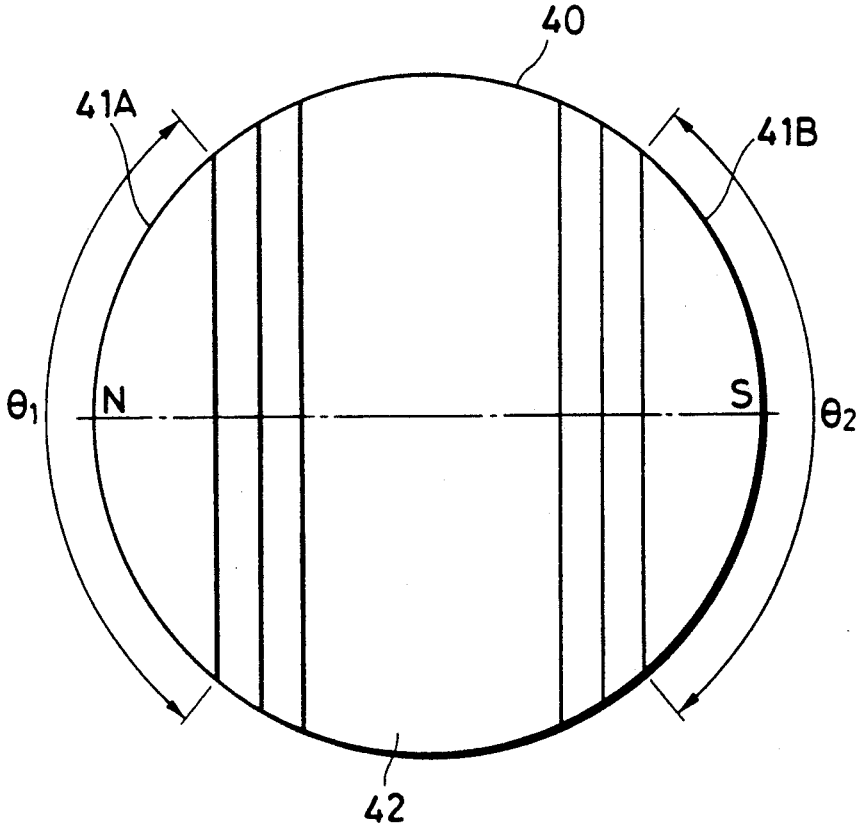
FIGS. 9 and 10 are plan and fragmental cross-sectional views of a permanent magnet magnetic circuit according to a third embodiment of the present invention, respectively.
Figure 10:
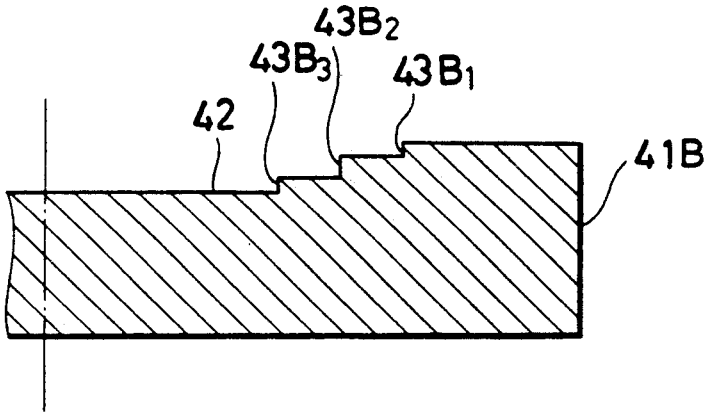
Figure 11:
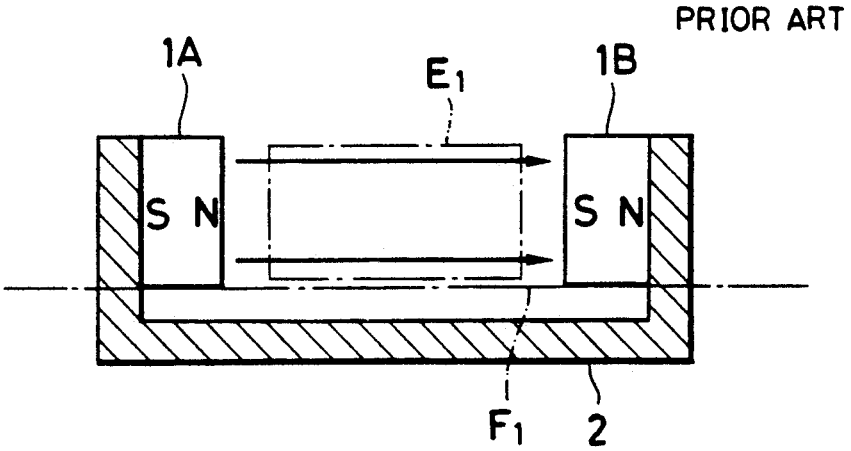
FIG. 11 is a front elevation of a first example of the prior art magnetic circuit.
Figure 12:
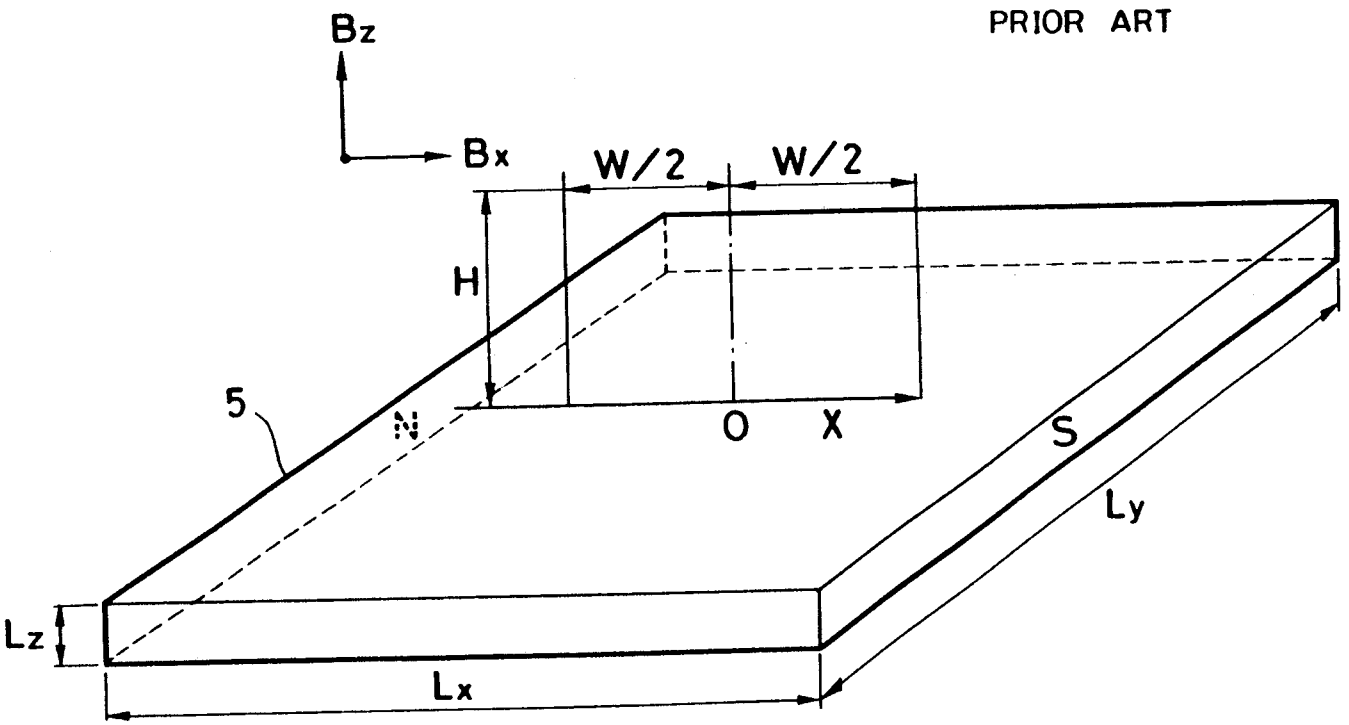
FIG. 12 PRIOR ART
FIGS. 12 and 13 are perspective and front elevational views of a second example of the prior art magnetic circuit, respectively.
Figure 13:
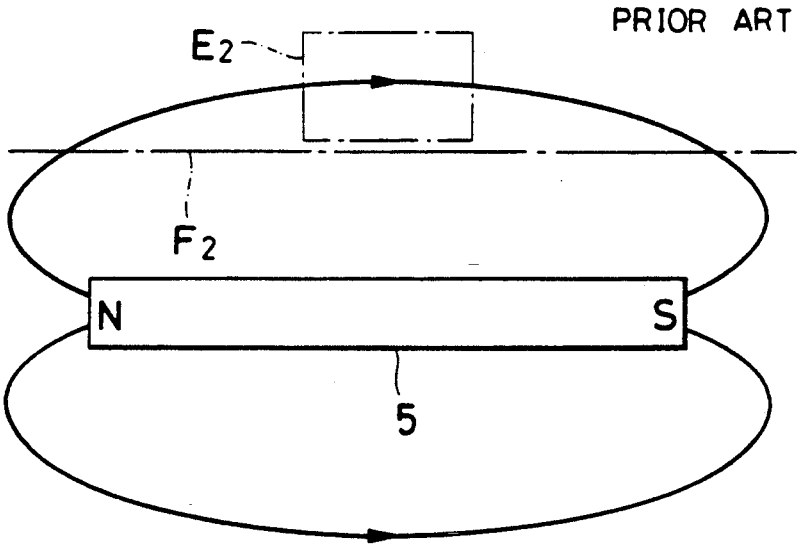
Figure 14:
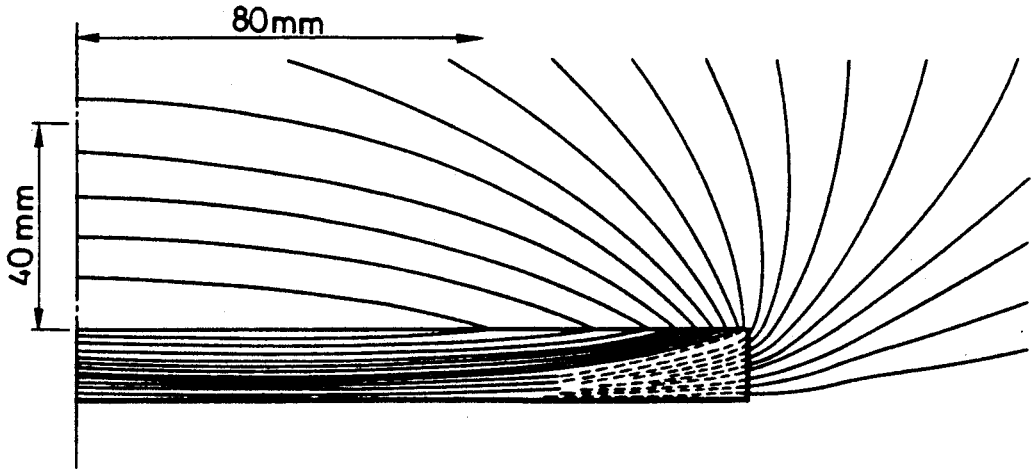
FIG. 14 illustrates the distribution of lines of magnetic force near the right edge of the magnet block in FIG. 13.

FIGS. 9 and 10 show a third embodiment of the present invention. This embodiment is similar to the first embodiment except for the block geometry. Used in this embodiment is a disk-shaped magnet block 40 having a pair of opposite edge surface segments, that is, arcuate segments included within angles $\theta 1$ and $\theta 2$ where main magnetic poles 41A and 41B are formed by magnetization. The main magnetic poles 41A and 41B are N and S poles, respectively, in the illustrated embodiment. The magnet block 40 has a pair of major surfaces joining the opposite edge surface segments (41A and 41B) and extending substantially perpendicular to the segments (in the cross section of FIG. 10). A transverse channel 42 is defined in one major surface. The channel 42 has symmetric steps defining pairs of opposed inner surface portions disposed inward of the opposite edge surface segments. As seen from FIG. 10, in the opposed inner surface portions disposed inward of the main magnetic pole 41B of one polarity are formed compensating magnetic poles $43B_1$, $43B_2$ and $43B_3$ of opposite polarity by magnetization. Similarly, in the opposed inner surface portions disposed inward of the main magnetic pole 41A of opposite polarity are formed compensating magnetic poles of one polarity.

The results of the third embodiment are equivalent to those of the first embodiment.

In all the embodiments, the magnet block may be either a unitary permanent magnet block or an assembly of a plurality of permanent magnet pieces.

There has been described a permanent magnet magnetic circuit capable of producing a unidirectional magnetic field substantially free of unnecessary perpendicular magnetic force components without surrounding the region where the unidirectional magnetic field is to be produced. The magnetic circuit is advantageously applicable to semiconductor fabricating apparatus and similar apparatus where restrictions are imposed on the attachment or location of the circuit.

While we have shown and described particular embodiments of our invention, it will be obvious to those skilled in the art that various changes and modifications may be made without departing from the invention in its broader aspects.

We claim:

1. A permanent magnet magnetic circuit comprising:

a unitary magnet block having first and second opposite outer edge surfaces and a channel defined between said first and second opposite outer edge surfaces, said channel including first and second opposed inner surface portions disposed inward of said first and second opposite outer edge surfaces;

first and second main magnetic poles of opposite polarities respectively situated at said first and second opposite outer edge surfaces for creating a loop pattern of unidirectional parallel lines of magnetic force extending continuously between the first and second opposite outer edge surfaces;

first and second auxiliary magnetic poles respectively situated at said first and second opposed inner surface portions, the first auxiliary magnetic pole having an opposite polarity to that of the first main magnetic pole and the second auxiliary magnetic pole having an opposite polarity to that of the second main magnetic pole, for establishing a unidirectional parallel magnetic field in an open space located outside a surface of the magnet block in the channel;

wherein said channel is recessed to define said first and second opposed inner surface portions and said first and second main magnetic poles and first and second auxiliary magnetic poles are both formed in the unitary magnet block.

2. The magnetic circuit of claim 1, wherein said channel is recessed stepwise to define said first and second opposed inner surface portions.

3. The magnetic circuit of claim 1, wherein said channel is continuously recessed to define said first and second opposed inner surface portions.

4. The magnetic circuit of claim 1, wherein said magnet block is of rectangular shape.

5. The magnetic circuit of claim 1, wherein said magnet block is of circular shape.

6. The magnetic circuit of claim 1, wherein the lines of force are substantially linear in the magnetic field region.

* * * * *